US011771279B2

(12) United States Patent
Chang et al.

(10) Patent No.: US 11,771,279 B2
(45) Date of Patent: Oct. 3, 2023

(54) CLEANER

(71) Applicant: LG ELECTRONICS INC., Seoul (KR)

(72) Inventors: Daeho Chang, Seoul (KR); Jinhyouk Shin, Seoul (KR); Kyoungho Ryou, Seoul (KR); Donggeun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 380 days.

(21) Appl. No.: 16/894,156

(22) Filed: Jun. 5, 2020

(65) Prior Publication Data

US 2020/0383540 A1 Dec. 10, 2020

(30) Foreign Application Priority Data

Jun. 7, 2019 (KR) ..... 10-2019-0067549

(51) Int. Cl.

| | |
|---|---|
| ***A47L 9/10*** | (2006.01) |
| ***A47L 9/20*** | (2006.01) |
| ***A47L 9/12*** | (2006.01) |
| ***A47L 9/16*** | (2006.01) |

(52) U.S. Cl.

CPC ..... *A47L 9/108* (2013.01); *A47L 9/127* (2013.01); *A47L 9/1608* (2013.01); *A47L 9/20* (2013.01)

(58) Field of Classification Search

CPC ..... A47L 9/108; A47L 9/127; A47L 9/1608; A47L 9/20; A47L 9/1625; A47L 9/1641; A47L 9/00; A47L 9/16; A47L 9/1683; A47L 5/24

USPC ..... 15/347

See application file for complete search history.

(56) References Cited

U.S. PATENT DOCUMENTS 1,345,478 A * 7/1920 Cliffe ..... A47L 5/30 15/DIG. 8
3,909,219 A * 9/1975 Fromknecht ..... A47L 9/127 55/378
7,611,558 B2 11/2009 Oh et al.

(Continued)

FOREIGN PATENT DOCUMENTS

CN 102302351 A 1/2012
CN 102342798 A 2/2012

(Continued)

*Primary Examiner* — Orlando E Aviles
*Assistant Examiner* — Jacob Adam Montgomery
(74) *Attorney, Agent, or Firm* — Bryan Cave Leighton Paisner LLP

(57) ABSTRACT

A cleaner having a housing that includes a suction opening, a cyclone part configured to separate dust from air suctioned through the suction opening, and a dust bin configured to store dust separated from air by the cyclone part, a guide fixed in position in the housing, a frame configured to be movable to a compression standby position and a dust compression position for compressing dust in the dust bin in the housing and brought into contact with the guide at the compression standby position, a first guide part provided at the frame, and a second guide part provided at the guide and coupled to the first guide part at the compression standby position of the frame, wherein one of the first guide part and the second guide part is a projection and the other is a recess in which the projection is accommodated.

20 Claims, 12 Drawing Sheets

(56) References Cited

U.S. PATENT DOCUMENTS

| | | | | |
|---|---|---|---|---|
| 2008/0263816 | A1* | 10/2008 | Oh | A47L 9/26 15/347 |
| 2008/0264007 | A1* | 10/2008 | Oh | A47L 9/1683 55/304 |
| 2009/0293221 | A1* | 12/2009 | Hwang | A47L 9/108 15/347 |
| 2010/0229332 | A1* | 9/2010 | Kang | A47L 9/108 15/347 |
| 2018/0132685 | A1* | 5/2018 | Muir | A47L 9/32 |
| 2018/0132686 | A1 | 5/2018 | Muir et al. | |
| 2019/0183301 | A1 | 6/2019 | Hwang et al. | |

FOREIGN PATENT DOCUMENTS

| | | | | | |
|---|---|---|---|---|---|
| CN | 102525341 | A | | 7/2012 | |
| CN | 103300795 | A | | 9/2013 | |
| CN | 204722978 | U | | 10/2015 | |
| CN | 108065862 | A | | 5/2018 | |
| GB | 2487599 | A | * | 8/2012 | A47L 9/108 |
| JP | 2013-183760 | A | | 9/2013 | |
| KR | 10-2006-0117001 | A | | 11/2006 | |
| KR | 10-2008-0097110 | A | | 11/2008 | |
| KR | 101750312 | B1 | | 6/2017 | |
| KR | 10-2018-0023790 | A | | 3/2018 | |

* cited by examiner

CLEANER

CROSS-REFERENCE TO RELATED APPLICATIONS

This application claims the benefit of the Korean Patent Application No. 10-2019-0067549, filed on Jun. 5, 2019, which is hereby incorporated by reference as if fully set forth herein.

BACKGROUND

Field

The present disclosure relates to a cleaner.

Related Art

A cleaner is a device that performs cleaning by suctioning or wiping dust or foreign substances located in a cleaning target area.

Such a cleaner may be classified as a manual cleaner, which requires a user to directly moves the cleaner, and an automatic cleaner, drives on its own and does not require a user to manually move the cleaner.

In addition, the manual cleaner may be classified as, e.g., a canister type cleaner, an upright type cleaner, a handy type cleaner, a stick type cleaner, etc.

For example, US Patent Publication No. US2018/0132685A1 discloses a compression mechanism having a dust compression part compressing dust in a dust bin. The compression mechanism may include a dust bin having an opening, a filter purifying air in the dust bin, a shroud surrounding the filter, a dust compression part disposed to surround the shroud, a handle operated by a user to move the dust compression part, and a link connected to the handle. When the dust compression part is lowered by an operation force of the handle transferred thereto through the link, the dust compression part compresses dust in the dust bin. Because the dust compression part moves in contact with an inner circumferential surface of the dust bin, the inner circumferential surface of the dust bin may be cleaned. At least a portion of the dust compression part is located higher than the opening at the compression standby position.

However, when the dust compression part, which has been lowered, rises, if the dust compression part does not accurately move to a standby position, the dust compression part may act as a flow resistance of air and dust flowing through the opening to degrade dust separation performance. Moreover, even if the dust compression part is in contact with the inner circumferential surface of the dust bin, there is a possibility that dust may accumulate between the dust compression part and the inner circumferential surface of the dust bin, and in this case, a vertical movement of the dust compression part is not smooth, resulting in that the dust compression part cannot accurately move to the compression standby position.

SUMMARY

The present disclosure provides a cleaner in which a compression mechanism, which has moved for compression, accurately moves to a compression standby position.

The present disclosure provides a cleaner in which a compression mechanism accurately moves to a compression standby position by enabling relative rotation of transfer parts for transferring an operation force of an operating part disposed to be eccentric from the center of a movable part to the movable part.

The present disclosure provides a cleaner in which a compression mechanism guides air and dust introduced through a suction opening at a compression standby position of the compression mechanism.

To achieve these and other advantages and in accordance with the disclosure, as embodied and broadly described herein, there is provided a cleaner including: a housing including a dust bin, a frame configured to be movable in the housing and to press dust stored in the dust bin, and a guide brought into contact with the frame at a compression standby position of the frame.

The frame may include a first guide part and the guide may include a second guide part so that the frame may be positioned at a regular position with respect to the guide. At the compression standby position, the first guide part and the second guide part may be coupled. One of the first guide part and the second guide part may be a projection and the other may be a recess accommodating the projection.

The frame may be formed in a ring shape, for example, and a plurality of first guide parts may be spaced apart from each other in a circumferential direction of the frame. A plurality of second guide parts may be provided in the guide to correspond to the plurality of first guide parts.

The cleaner may further include an operating part provided outside the housing and operated by a user to move the frame, and a transfer part configured to transfer an operation force of the operating part to the frame.

The transfer part may include a first transfer part coupled (e.g., connected) to the operating part and a second transfer part connected to the first transfer part and the frame. The first transfer part may be coupled to the second transfer part to surround a portion of an outer side of the second transfer part by double injection molding.

The second transfer part may include a coupling recess continuously formed in a circumferential direction, the first transfer part may include a coupling projection accommodated in the coupling recess, and the first transfer part and the second transfer part may relatively rotate by the coupling recess and the coupling projection.

In another aspect of the present disclosure, there is provided a cleaner including: a housing including a suction opening, a cyclone part configured to separate dust from air suctioned through the suction opening, and a dust bin configured to store dust separated from air by the cyclone part; a guide fixed in position in the housing; a frame configured to be movable to a compression standby position and a dust compression position for compressing dust in the dust bin in the housing and brought into contact with the guide at the compression standby position; a first guide part provided at the frame; and a second guide part provided at the guide and coupled to the first guide part at the compression standby position of the frame.

One of the first guide part and the second guide part may be a projection and the other may be a recess in which the projection is accommodated.

An inner circumferential surface of the guide may guide a flow of air in the housing, and the frame may be disposed to surround an outer circumferential surface of the guide.

The second guide part may be provided on the outer circumferential surface of the guide. The frame may include a contact body in contact with the outer circumferential surface of the guide, and the first guide part may be provided on the contact body.

The guide may include a guide body inclined with respect to an axis of a cyclone flow of the cyclone part. The second guide part may protrude from the guide body.

The guide body may include a seating portion provided in a recessed form and configured to allow the contact body to be seated thereon, and the second guide part may be provided in the seating portion.

A plurality of first guide parts may be spaced apart from each other in a circumferential direction of the frame, and the second guide part may be provided in the same number as the plurality of first guide parts.

The cleaner may further include: an operating part provided outside the housing and operated by a user to move the frame and a transfer part configured to transfer an operation force of the operating part to the frame.

The frame may include a frame body including the plurality of first guide parts and disposed to surround the guide, a lower extension wall extending downward from the frame body, and a coupling part provided on the lower extension wall and configured to allow the transfer part to be coupled thereto. Some of the plurality of first guide parts may be located on the opposite side of the coupling part.

The others of the plurality of first guide parts may be located in a region between the some of the plurality of first guide parts and the coupling part in a circumferential direction of the frame body.

The frame may include a frame body including the first guide part and disposed to surround the guide and a frame guide extending downward from the frame body and configured to guide air and dust suctioned through the suction opening.

The transfer part may be connected to a position spaced apart from a center of the frame. The transfer part may include a first transfer part coupled to the operating part and a second transfer part coupled to the first transfer part and the frame and extending parallel to the axis of the cyclone flow of the cyclone part.

The first transfer part may be coupled to the second transfer part to surround a portion of an outer side of the second transfer part by double injection molding. The second transfer part may be formed of a metal material and the first transfer part may be formed of a non-metal material.

The second transfer part may include a coupling recess continuously formed in the circumferential direction, the first transfer part may include a coupling projection accommodated in the coupling recess, and the first transfer part and the second transfer part may relatively rotate by the coupling recess and the coupling projection.

In another aspect of the present disclosure, there is provided a cleaner including: a housing including a cyclone part configured to separate dust from suctioned air and a dust bin configured to store dust separated from the air by the cyclone part; a frame configured to be movable to a compression standby position and a dust compression position for compressing dust in the dust bin in the housing; a guide located in an inner region at the compression standby position of the frame and configured to support the frame; a first guide part provided in the frame; and a second guide part provided in the guide and coupled to the first guide part at the compression standby position. One of the first guide part and the second guide part may be a projection and the other may be a recess in which the projection is accommodated.

The first guide part and the second guide part may be coupled in a direction parallel to an axis of a cyclone flow of the cyclone part.

The frame may include a contact body in contact with the guide and the first guide part may be provided on the contact body.

Each of the guide and the frame may include an inclined surface with respect to a horizontal line, the first guide part may be provided on the inclined surface of the frame, and the second guide part may be provided on the inclined surface of the guide.

A plurality of first guide parts may be spaced apart from each other in a circumferential direction on the frame and may be arranged at the same height.

BRIEF DESCRIPTION OF THE DRAWINGS

The accompanying drawings constitute a part of this specification and illustrate an embodiment of the present disclosure and together with the specification, explain the present disclosure.

DETAILED DESCRIPTION OF THE DISCLOSURE

Figure 1:
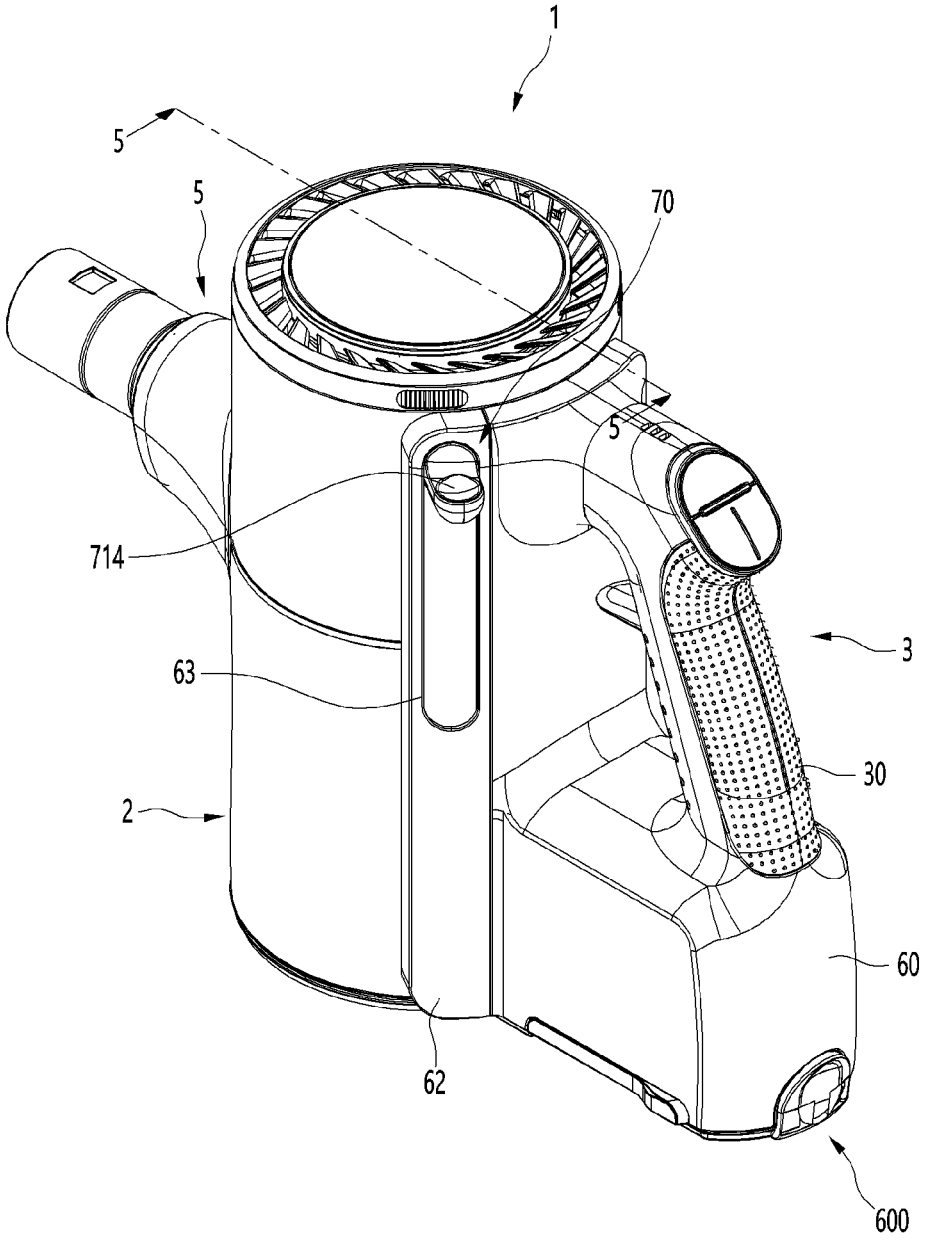
FIG. 1 is a perspective view of a cleaner according to an embodiment of the present disclosure.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to a person skilled in the relevant art and having possession of this disclosure, are to be considered within the scope of the invention.

As used herein, various singular forms "a," "an" and "the" are intended to include various plural forms as well, unless context clearly indicates otherwise. For example, a term "a" or "an" shall mean "one or more," even though a phrase "one or more" is also used herein. Use of the optional plural "(s)," "(es)," or "(ies)" means that one or more of the indicated feature is present.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, features described with respect to certain embodiments may be combined in or with various other embodiments in any permutational or combinatory manner. Different aspects or elements of example embodiments, as disclosed herein, may be combined in a similar manner.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component.

Figure 2:
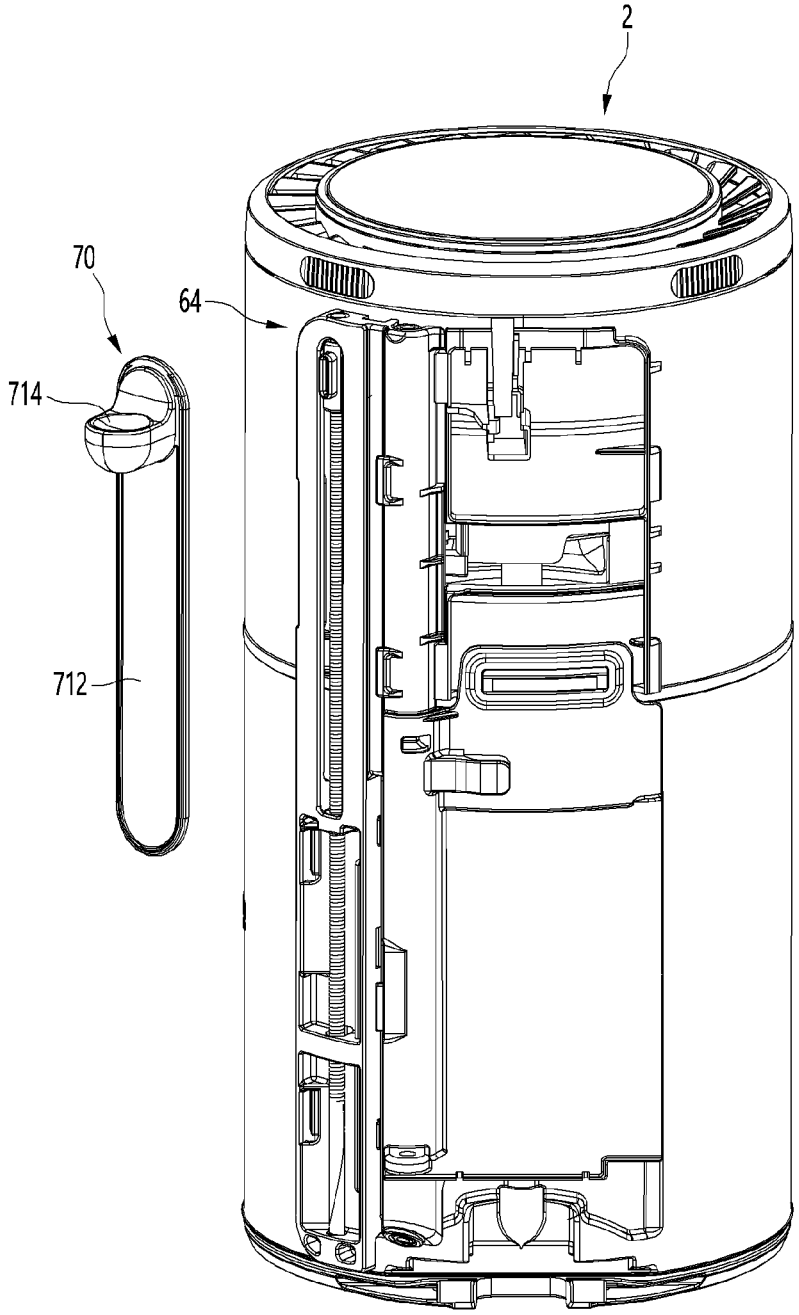
FIG. 2 is a perspective view showing a state where a handle part is separated from a cleaner according to an embodiment of the present disclosure.
Figure 3:
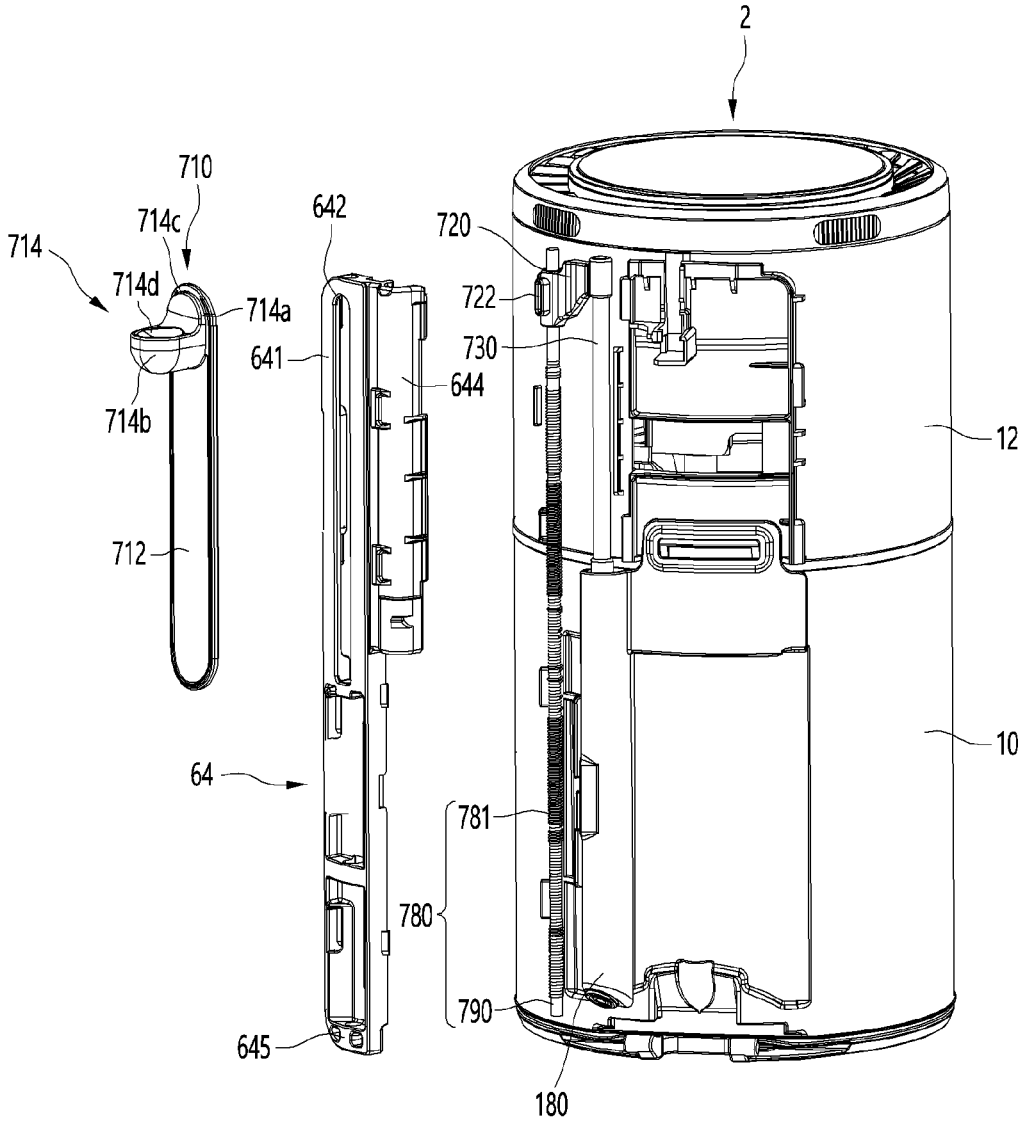
FIG. 3 is a view showing a state where a guide frame is separated from FIG. 2.
Figure 4:
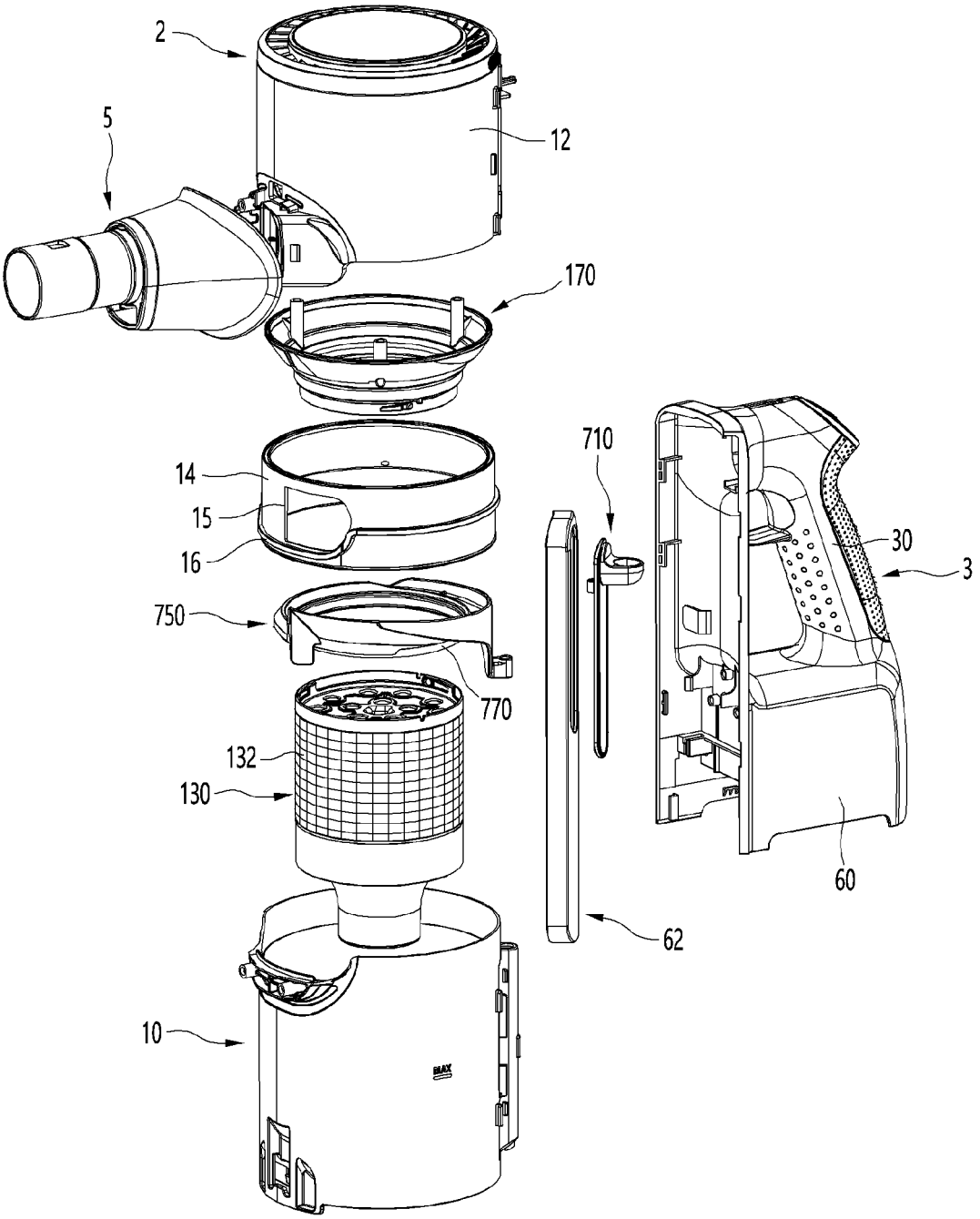
FIG. 4 is an exploded perspective view of a cleaner according to an embodiment of the present disclosure.
Figure 5:
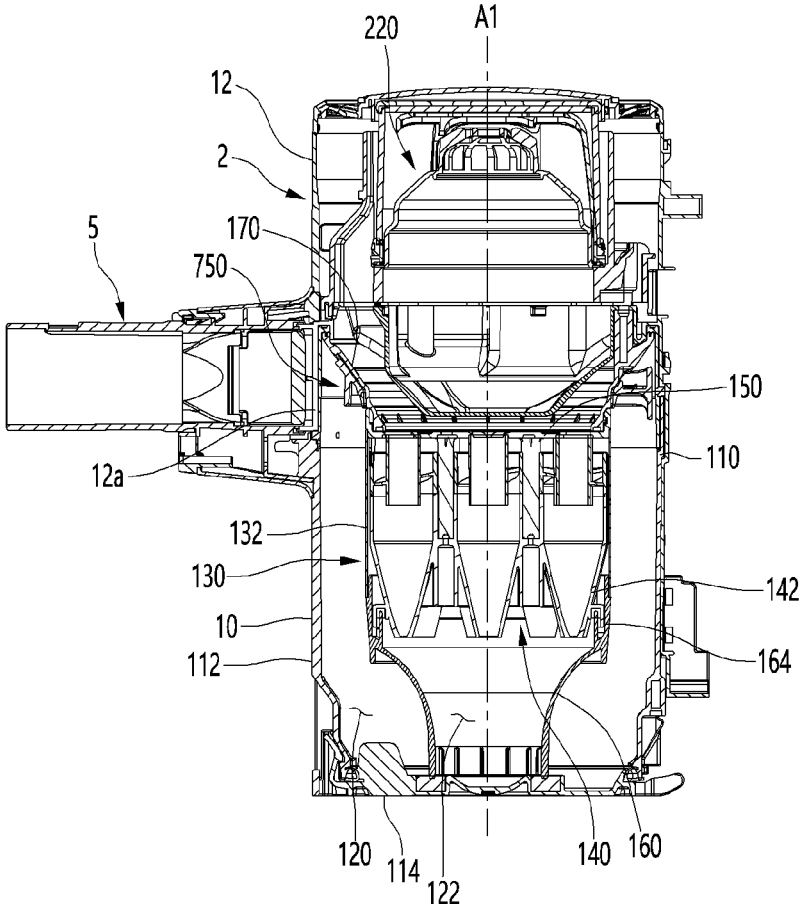
FIG. 5 is a cross-sectional view taken along line 5-5 of FIG. 1.

FIG. 1 is a perspective view of a cleaner according to an embodiment of the present disclosure. FIG. 2 is a perspective view showing a state where a handle part is separated from a cleaner according to an embodiment of the present disclosure. FIG. 3 is a view showing a state where guide frame is separated from FIG. 2. FIG. 4 is an exploded perspective view of a cleaner according to an embodiment of the present disclosure. FIG. 5 is a cross-sectional view taken along line 5-5 of FIG. 1.

Referring to FIGS. 1 to 5, the cleaner 1 according to an embodiment of the present disclosure may include a main body 2. The cleaner 1 may further include a suction part 5 (or suction inlet) through which air containing dust is suctioned. The suction part 5 may guide the air containing dust to the main body 2.

The cleaner 1 may further include a handle part 3 coupled to the main body 2. The handle part 3 may be located on the opposite side of the suction part 5 in the main body 2. However, the positions of the suction part 5 and the handle part 3 are not limited thereto. An extending pipe may be connected to the suction part 5. A suction nozzle may be connected to the extending pipe.

The main body 2 may separate the dust suctioned into the inside through the suction part 5 and store or hold the separated dust.

In one example, the main body 2 may include a dust separator. The dust separator may include a first cyclone part 110 capable of separating dust by a cyclone flow, e.g., helical pattern. The first cyclone part 110 may communicate with the suction part 5.

The air and dust suctioned through the suction part 5 spirally flows along an inner circumferential surface of the first cyclone part 110.

The dust separator may further include a second cyclone part 140 for separating dust from the air discharged from the first cyclone part 110.

The second cyclone part 140 may include a plurality of cyclone bodies 142 arranged in parallel. The air discharged from the first cyclone part 110 may be divided into the plurality of cyclone bodies 142 and pass therethrough.

The dust separator may include a single cyclone part or more than one cyclone part.

The main body 2 may be formed in a cylindrical shape, for example, and an outer shape thereof may be formed by a plurality of housings.

In one embodiment, the main body 2 may include a first housing 10 having a substantially cylindrical shape and a second housing 12 coupled to an upper side of the first housing 10 and having a substantially cylindrical shape.

An upper portion of the first housing 10 may define the first cyclone part 110, and a lower portion of the first housing 10 may define a dust bin 112 for storing dust separated from the first cyclone part 110. Alternatively, a lower side of the second housing 12 may define the first cyclone part 110.

A lower side of the first housing 10 (e.g., a lower side of the dust bin 112) may be opened and closed by a housing cover 114 that rotates by a hinge.

To seal a boundary between the first housing 10 and the second housing 12 in a state where the first housing 10 and the second housing 12 are coupled, the cleaner 1 may further include a sealing member 16 and a support body 14 supporting the sealing member 16.

Upper and lower sides of each of the first housing 10 and the second housing 12 are open. That is, each of the housings 10 and 12 may include an upper opening and a lower opening.

The support body 14 may be formed in a cylindrical shape. Here, an outer diameter of the support body 14 may be the same as or less than an inner diameter of the first housing 10 so that the support body 14 may be inserted into the first housing 10 through the upper opening of the first housing 10.

Likewise, the outer diameter of the support body 14 may be the same as or less than an inner diameter of the second housing 12 so that the support body 14 may be inserted into the second housing 12 through the lower opening of the second housing 12.

The support body 14 may include a communication opening 15 through which air passes or flows through. The communication opening 15 may communicate with the suction part 5.

The sealing member 16 may be coupled to the support body 14 to surround an outer circumferential surface of the support body 14. For example, the sealing member 16 may be integrally formed with the support body 14 by an insert injection molding process. Alternatively, the sealing member 16 may be coupled or adhered to the outer circumferential surface of the support body 14, such as by an adhesive.

The main body 2 may include a suction opening **12*a* through which air guided through the suction part 5** passes or flows through.

One of the first housing 10 and the second housing 12 may include the suction opening **12*a*, or the first housing 10 may form a part of the suction opening 12*a* and the second housing 12 may form another part of the suction opening 12*a***.

Hereinafter, an embodiment in which the second housing 12 includes the suction opening **12*a*** will be described.

When the second housing 12 is coupled to the first housing 10, the suction opening **12*a* of the second housing 12 and the communication opening 15 of the support body 14** are aligned.

The suction opening 12*a* is aligned with the suction part 5. With such configuration, dust and air may be introduced into the first cyclone part 110 through the inside of the suction part 5, the suction opening 12*a*, and the communication opening 15.

In this embodiment, the support body 14 may be omitted. In this embodiment, an upper end of the first housing 10 may be in direct contact a lower end of the second housing 12. In addition, dust and air may flow into the first cyclone part 110 through the suction opening 12*a* after passing through the inside of the suction part 5.

In the present disclosure, a configuration for guiding air from the suction part 5 to the first cyclone part 110 may be referred to as a suction passage of the main body 2.

Accordingly, the suction passage may include only the suction opening 12*a* or may include the suction opening 12*a* and the communication opening 15.

The main body 2 may further include a filter part 130 disposed to surround the second cyclone part 140. The filter part 130 may be formed in a cylindrical shape, for example, and guide air separated from dust in the first cyclone part 110 to the second cyclone part 140. The filter part 130 filters dust from air in the process in which air flows or passes there through.

The filter part 130 may be arranged to surround an axis A1 of a cyclone flow of the first cyclone part 110.

To this end, the filter part 130 may include a mesh portion 132 having a plurality of holes. The mesh portion 132 may be formed of a metal material but is not limited thereto. Since the mesh portion 132 filters air, dust may accumulate on the mesh portion 132, and thus the mesh portion 132 may need to be cleaned.

In the present disclosure, the cleaner 1 may further include a compression mechanism 70 capable of compressing dust stored in the first dust storage 120.

Since capacity of the first dust storage 120 is limited, the amount of dust stored in the first dust storage 120 may accumulate during repeated cleaning, and thus a usage time of and the number of times the cleaner is used may be limited.

The user may cause or manipulate the housing cover 114 to open the first dust storage 120 in order to remove dust of the first dust storage 120.

In this embodiment, when dust stored in the first dust storage 120 is compressed using the compression mechanism 70, density of the dust stored in the first dust storage 120 increases, and thus a volume thereof decreases.

Therefore, according to the present embodiment, the number of times for emptying the dust bin 112 is reduced, and accordingly, requiring less frequent emptying of the dust bin.

The compression mechanism 70 may also clean the mesh portion 132 during a movement process.

The compression mechanism 70 may include a movable part 750 (or compression part) movable in the main body 2, an operating part 710 (or manipulating part) operated by the user to move the movable part 750, and transfer parts 720 and 730 transferring an operation force of the operating part 710 to the movable part 750.

The movable part 760 may have a ring-like shape such that interference with a structure provided in the first dust storage 120 may be prevented. The operating part 710 may have a structure that the user may manually press.

For example, the operating part 710 may be disposed outside the main body 2. For example, the operating part 710 may be located outside the first housing 10 and the second housing 12.

At least a portion of the operating part 710 may be located above the first housing 10. Also, at least a portion of the operating part 710 may be located above the movable part 750.

The operating part 710 may include a pressing part 714. The pressing part 714 may be located above the first housing 10 and the movable part 750.

The operating part 710 may include an operating part body 712. The operating part body 712 may have a vertical length that is longer than a horizontal width thereof. The pressing part 714 may protrude from an upper portion of the operating part body 712.

The pressing part 714 may protrude in the horizontal direction from the operating part body 712 in a state where the operating part body 712 is disposed in a vertical direction.

In one embodiment, the pressing part 714 may be located closer to an upper end than a lower end of the operating part body 712. The pressing part 714 may protrude from a position spaced apart downward from the upper end of the operating part body 712.

The pressing part 714 may include a first portion 714*a* protruding from the operating part body 712 and a second portion 714*b* additionally protruding from the first pressing part 714*a*.

The second portion 714*b* may protrude from a position spaced apart by a predetermined distance in a downward direction from an upper end 714*c* of the first portion 714*a*.

The user may move the operating part 710 in a downward direction by pressing an upper surface 714*d* of the second portion 714*b*. Therefore, an upper surface 714*d* of the second portion 714*b* may function as a pressing surface.

The operating part 710 may further include a coupling projection (See 716 of FIG. 6) located on the opposite side of the pressing part 714 in the operating part body 712.

The handle part 3 may include a handle body 30 for the user to grip or manipulate and a battery housing 60 disposed below the handle body 30 and accommodating a battery 600.

The handle body 30 and the battery housing 60 may be disposed in an up-down direction, and the handle body 30 may be located above the battery housing 60.

The handle part 3 may guide movement of the operating part 710, while covering a portion of the operating part 710.

In one embodiment, the handle part 3 may further include an operating part cover 62. The operating part cover 62 may be located on the side of the handle body 30 and the battery housing 60.

The operating part cover 62 may be formed integrally with the handle body 30 and the battery housing 60 or may be formed separately from the handle body 30 and the battery housing 60.

If the operating part cover 62 is formed separately from the handle body 30 and the battery housing 60, the operating part cover 62 may be coupled to the main body 2.

In a state where the user grips the handle body 30 by a right hand, the operating part 710 may be located on the left of the handle body 30. Of course, in a state where the user grips the handle body 30 by a left hand, the operating part 710 may be located on the right of the handle body 30. With such configuration, the user may more easily operate the operating part 710 by a hand that does not grip the handle body 30.

The operating part 710 may move in a direction parallel to the axis A1 of the cyclone flow of the first cyclone part 110.

For example, the axis A1 of the cyclone flow of the first cyclone part 110 may extend in the up-down direction in a state where the dust bin 112 is placed on the floor. Therefore, the operating part 710 may also be moved in the up-down direction in a state where the dust bin 112 is placed on the floor.

A slot 63 may be provided on the operating part cover 62 for movement of the operating part 710. The pressing part 714 of the operating part 710 may penetrate the slot 63.

A vertical length of the operating part body 712 may be longer than a vertical length of the slot 63. A horizontal width of the operating part body 712 may be longer than a horizontal width of the slot 63.

The horizontal width of the pressing part 714 may be the same as or less than the horizontal width of the slot 63. The vertical length of the pressing part 714 may be less than the vertical length of the slot 63. A protruding length of the pressing part 714 may be longer than a front-rear width of the operating part cover 62.

Therefore, the pressing part 714 may penetrate the slot 63 and may protrude outside the operating part cover 62 through the slot 63.

The horizontal width of the operating part body 712 may be less than the horizontal width of the operating part cover 62. The vertical length of the operating part body 712 may be less than the horizontal width of the operating part cover 62.

A front-rear width of the operating part body 712 may be less than a front-rear width of the operating part cover 62. The operating part cover 62 may form a space for the operating part body 712 to locate. The operating part body 712 may move in the up-down direction in a state where the operating part body 712 is located in the operating part cover 62.

In the operating part cover 62, the operating part body 712 may move between the first position and the second position.

For example, the first position is a position when the operating part body 712 has moved to the top, and the second position is a position when the operating part body 712 has moved to the bottom.

In a state where no external force is applied to the operating part 710, the operating part body 712 may be located at the first position. The operating part body 712 may cover the slot 63 in a state where the operating part body 712 is located at the first position.

In one embodiment, in a state where the operating part body 712 is located at the first position, the operating part body 712 may fully cover the slot 63 inside the operating part cover 62. Accordingly, in a state where the operating part body 712 is located at the first position, the operating part body 712 may be exposed to the outside of the slot 63 and a space inside the operating part cover 62 may be prevented from being exposed.

The slot 63 may also extend in a direction parallel to the extending direction of the axis A1 of the cyclone flow of the first cyclone part 110.

In this embodiment, since the extending direction of the axis A1 of the cyclone flow is the up-down direction, for example, the "up-down direction" described below may be understood as the extending direction of the axis A1 of the cyclone flow.

Since the movable part 750 is located in the main body 2, the operating part 710 is located outside the main body 2, one portion of the transfer parts 720 and 730 may be located outside the main body 2 and the other portion thereof may be located inside the main body 2 to connect the movable part 750 and the operating part 710.

Portions of the transfer parts 720 and 730 may penetrate the main body 2. Portions of the transfer parts 720 and 730 located outside the main body 2 may be covered by the handle part 3.

The transfer parts 720 and 730 may include a first transfer part 720. The first transfer part 720 may be coupled to the operating part 710. For example, the first transfer part 720 may include a coupling projection 722. The coupling projection 722 may be coupled to a projection coupling part (not shown) formed at the operating part body 712.

The coupling projection 722 may be formed to have a vertical length larger than a horizontal width thereof. The coupling projection 722 may restrict relative rotation of the operating part 710 with respect to the first transfer part 720 in a horizontal direction.

The transfer parts 720 and 730 may further include a second transfer part 730 coupled with the movable part 750. A portion of the second transfer part 730 may be located inside the main body 2 and the other portion thereof may be located outside the main body 2.

The second transfer part 730 may be directly connected to the first transfer part 720 or may be connected by an additional transfer part.

For example, FIG. 3 illustrates an embodiment where the second transfer part 730 is directly connected to the first transfer part 720. The first transfer part 720 may include a coupling part 724 to which the second transfer part 730 may be coupled.

The second transfer part 730 may extend in a direction parallel to the axis A1 of the cyclone flow.

In the case of this embodiment, although not limited thereto, the center of the movable part 750 may be located on the axis A1 of the cyclone flow or a vertical line passing through the center of the movable part 750 may be parallel to the axis A1 of the cyclone flow.

In this embodiment, the operating part 710 is disposed at a position eccentric from the center of the movable part 750. Therefore, eccentricity of the movable part 750 should be prevented in the process in which the movable part 750 moves up and down by the operation of the operating part 710.

If the movable part 750 moves up and down in an eccentric state, the movable part 750 may not form a horizontal state and may not move smoothly and the movable part 750 may not move accurately to a compression standby position.

When the transfer part for transferring an operation force of the operating part 710 to the movable part 750 includes one transfer part, a possibility that the movable part 750 is eccentric in the process of operating the operating part 710 is high.

For example, when the operating part 710 is directly connected to the movable part 750 or connected by a single transfer part, a path through which the operation force of the operating part 710 is transferred to the movable part 750 is relatively short.

If the operating part 710 is operated in an eccentric state with respect to a vertical line, the effect of eccentricity of the operating part 710 may directly act on the movable part 750 so there is a greater possibility that the movable part 750 is moved in the eccentric state.

However, as in the present disclosure, when the transfer part includes a plurality of transfer parts and transfers the operation force of the operating part to the movable part 750, even if the operating part 710 is eccentric with respect to the vertical line in the process of operating the operating part 710, the plurality of transfer parts may reduce the influence of the eccentric to minimize the amount of eccentricity of the movable part 750.

The main body 2 may further include a protruding body 180 for guiding the second transfer part 730. The protruding body 180 is, for example, present in a form protruding from the outside of the first housing 10. The protruding body 180 protrudes in a radial direction from the first housing 10.

The protruding body 180 may extend in a direction parallel to the extending direction of the axis A1 of the cyclone flow of the first cyclone part 110.

The protruding body 180 communicates with an internal space of the first housing 10, and the second transfer part 730 may move in the protruding body 180.

The cleaner 1 may further include a support mechanism 780 elastically supporting the compression mechanism 70.

The support mechanism 780 may include an elastic member 781 providing an elastic force to the compression mechanism 70. The elastic member 781 may provide the elastic force to the operating part 710 or the transfer parts 720 and 730. Hereinafter, an embodiment where the elastic member 781 supports the operating part 710 will be described.

The elastic member 781 may be disposed spaced apart from the second transfer part 730 in the horizontal direction. The elastic member 781 may be, for example, a coil spring and may be expanded and contracted in the up-down direction—but is not limited to such mechanism.

Here, at the first position of the operating part 710 (the position of the operating part 710 before the user presses the operating part 710), a length of the elastic member 781 may be longer than a length of the second transfer part 730.

When the length of the elastic member 781 is longer than the length of the second transfer part 730, the operating part 710 may be supported using the elastic member 781 having a low modulus of elasticity.

In this case, a required force may be reduced when pressing the operating part 710. In addition, when the operating part 710 is returned to its original position by the elastic member 781, noise that may occur as the upper end 714*c* of the first portion 714*a* in the pressing part 714 collides with a surface forming the slot 63 of the operating part cover 62 may also be reduced.

The support mechanism 780 may further include a support bar 790 supporting the elastic member 781 so that a horizontal movement of the elastic member 781 is limited in the vertical movement process of the operating part 710.

The support bar 790 may be formed in a cylindrical shape (not limited thereto). A vertical length of the support bar 790 may be longer than a vertical length of the elastic member 781.

The elastic member 781 may be disposed to surround the support bar 790. That is, the support bar 790 may be located at an inner region of the coil-shaped elastic member 781. An outer diameter of the support bar 790 may be the same as or smaller than an inner diameter of the elastic member 781.

One end of the support bar 790 may be coupled to the main body 2 or a transfer part cover, which will be described later. The first transfer part 720 may be coupled to the other end of the support bar 790.

Figure 6:
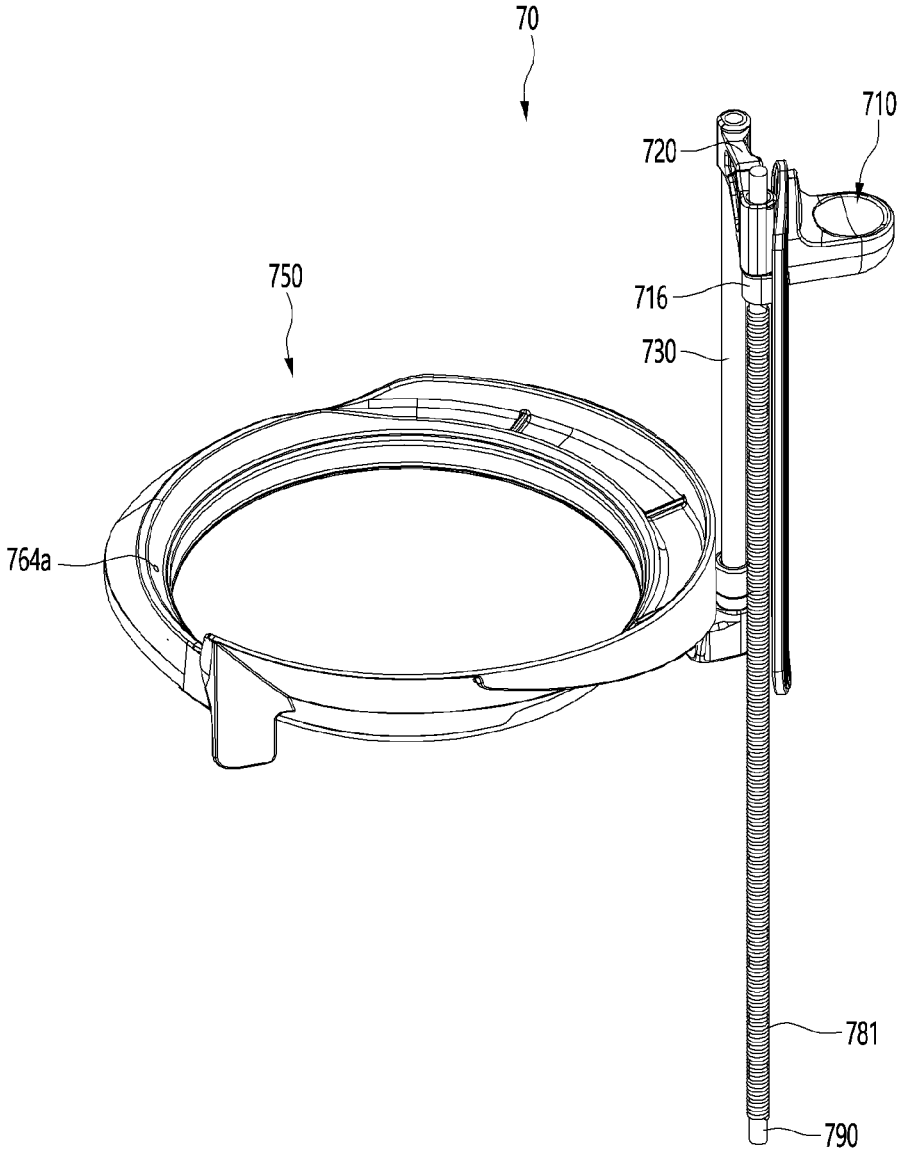
FIG. 6 is a perspective view of a compression mechanism according to an embodiment of the present disclosure.

Here, the support bar 790 may be coupled to the first transfer part 720 after passing through the coupling projection (See 716 in FIG. 6). A portion of the coupling projection (See 716 in FIG. 6) may be coupled to the first transfer part 720.

The upper end of the elastic member 781 may contact the lower side of the coupling projection (see 716 in FIG. 6).

The other end of the support bar 790 may be an upper end. The upper end of the support bar 790 may be coupled to penetrate the first transfer part 720.

Therefore, when the operating part 710 is operated downward, the coupling projection (See 716 in FIG. 6) may press against the elastic member 781.

The coupling projection (See 716 in FIG. 6) may be omitted in the operating part 710. In this case, when the operating part 710 is operated downward, the first transfer part 720 may press against the elastic member 781.

The first transfer part 720 may move up and down along the support bar 790. Accordingly, the support bar 790 may guide a vertical movement of the first transfer part 720. Therefore, the support bar 790 may be referred to as a guide bar.

The cleaner 1 may further include a transfer part cover 64 covering the transfer parts 720 and 730.

The transfer part cover 64 may be coupled to the main body 2 in a state of covering the transfer parts 720 and 730. The operating part cover 62 may cover at least a portion of the transfer part cover 64. In this embodiment, the transfer part cover 64 may be omitted and the operating part cover 62 may function as the transfer part cover 64. The transfer part cover 64 may also cover the support mechanism 780.

The transfer part cover 64 may also cover the support mechanism 780. The first portion 641 of the transfer part cover 64 may cover the first transfer part 720, the support bar 790, and the elastic member 781 at the side of the protruding body 180. The second portion 644 of the transfer part cover 64 may be located above the protruding body 180 and may cover the second transfer part 730.

The transfer part cover 64 may include a slot 642 at which the coupling projection 722 of the first transfer part 720 is located. The slot 642 may extend in the up-down direction.

The transfer part cover 64 may have a bar coupling part 645 to which the support bar 790 may be coupled.

Meanwhile, the main body 2 may further include a suction motor 220 for generating a suction force. The suction force generated by the suction motor 220 may act on the suction part 5. The suction motor 220 may be located in the second housing 12, for example.

The suction motor 220 may be located above the dust bin 112 and the battery 600 with respect to the extending direction of the axis A1 of the cyclone flow of the first cyclone part 110.

The main body 2 may further include an air guide 170 for guiding air passing or flowing through the filter part 130 to the suction motor 220.

In one example, the air guide 170 may guide air discharged from the second cyclone part 140 to the suction motor 220.

The second cyclone part 140 may be coupled to a lower side of the air guide 170. The filter part 130 may surround the second cyclone part 140 in a state of being coupled to the second cyclone part 140.

Therefore, the filter part 130 may also be located below the air guide 170. The movable part 750 may be disposed at a position surrounding the air guide 170 in a standby position.

The movable part 750 may include a cleaning part 770 for cleaning the filter part 130.

In this embodiment, a position of the movable part 750 in a state where the operating part 710 is not operated may be referred to as a "compression standby position." That is, the position of the movable part 750 when the operating part 710 is located at the first position may be referred to as the compression standby position. A position of the movable part 750 when the operating part 740 is located at the second position may be referred to as a "dust compression position."

At the compression standby position of the movable part 750, the entirety of the cleaning part 770 may be disposed not to overlap the filter part 130 in a direction in which air passes through the filter part 130.

For example, at the compression standby position of the movable part 750, the entirety of the cleaning part 770 may be located above the filter part 130.

Accordingly, at the compression standby position of the movable part 750, the cleaning part 770 may be prevented from acting as a flow resistance in the process in which air passes through the filter part 130.

A dust guide 160 may be provided below the second cyclone part 140. A lower side of the second cyclone part 140 may be coupled to an upper side of the dust guide 160. In addition, a lower side of the filter part 130 may be seated or accommodated on the dust guide 160.

The lower side of the dust guide 160 may be seated or accommodated on the housing cover 114. The dust guide 160 is spaced apart from the inner circumferential surface of the first housing 10 and divides or separates an internal space of the first housing into a first dust storage 120 storing dust separated at the first cyclone part 110 and a second dust storage 122 storing dust separated at the second cyclone part 140.

The inner circumferential surface of the first housing 10 and the outer circumferential surface of the dust guide 160 may define or form the first dust storage 120, and the inner circumferential surface of the dust guide 160 may define or form the second dust storage 122.

Hereinafter, the compression mechanism 70 will be described in more detail.

Figure 7:
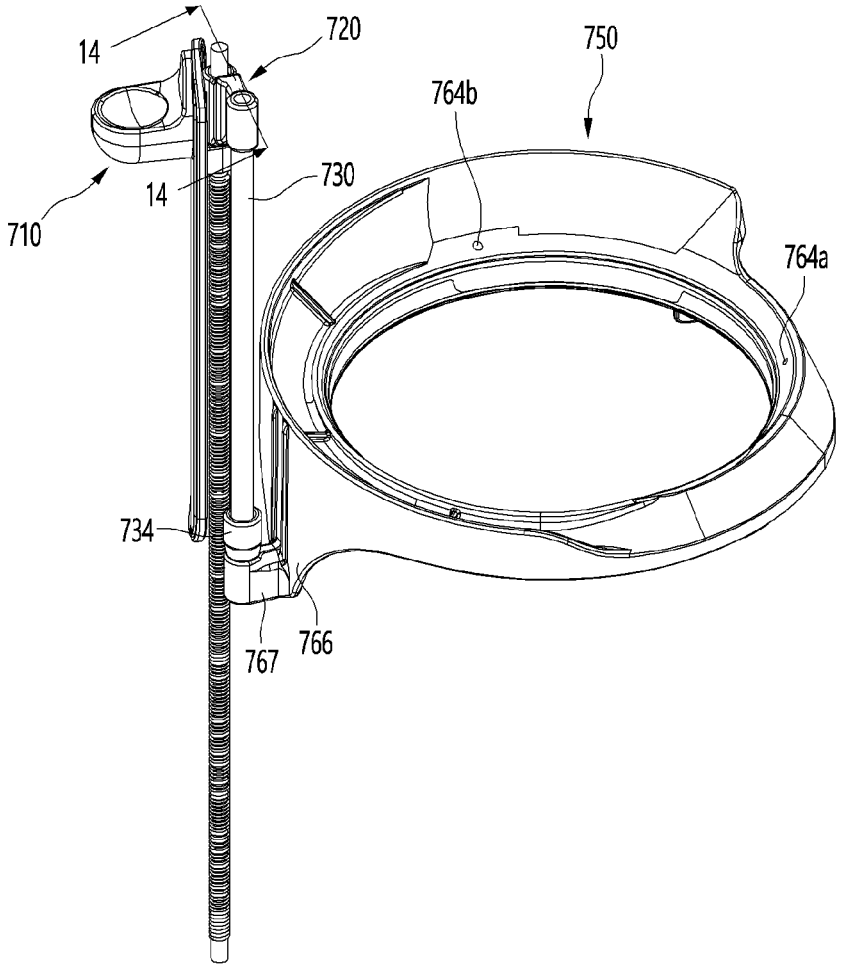
FIG. 7 is a perspective view of a compression mechanism according to an embodiment of the present disclosure.
Figure 8:
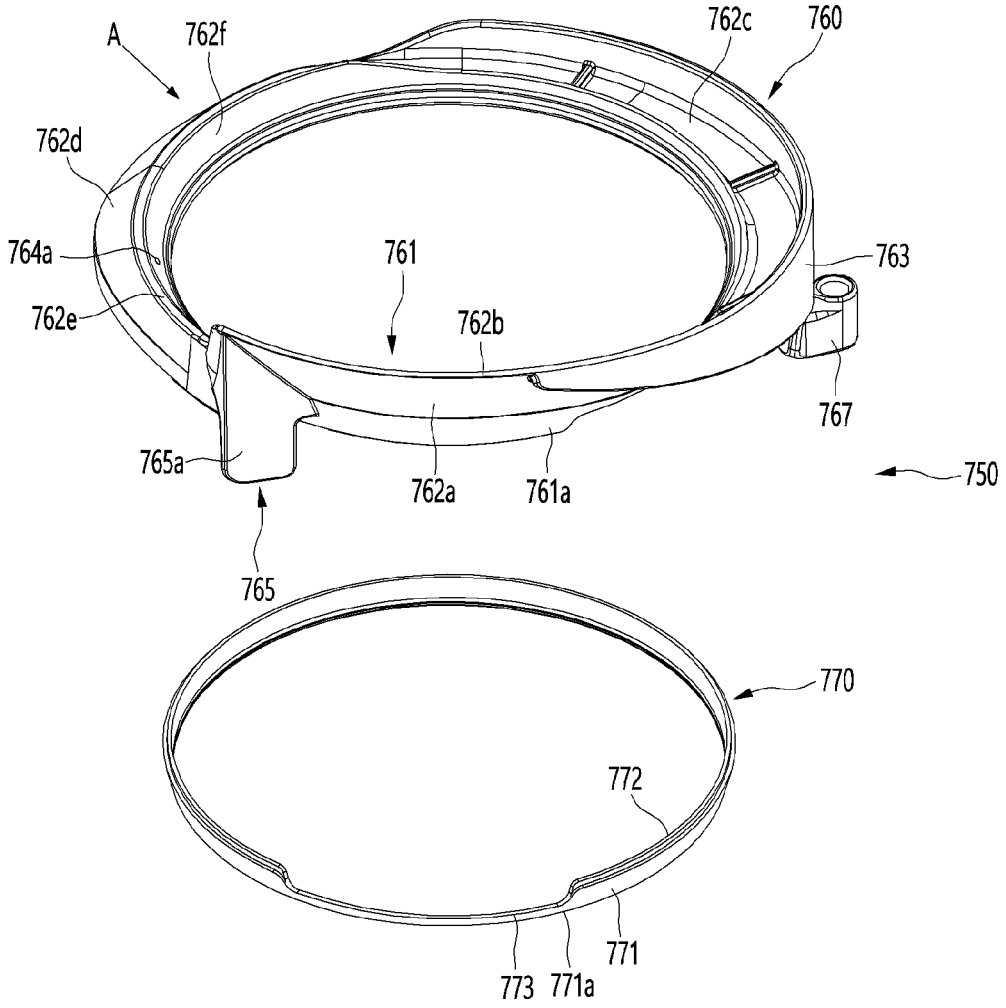
FIG. 8 is an exploded perspective view of a movable part according to an embodiment of the present disclosure.
Figure 9:
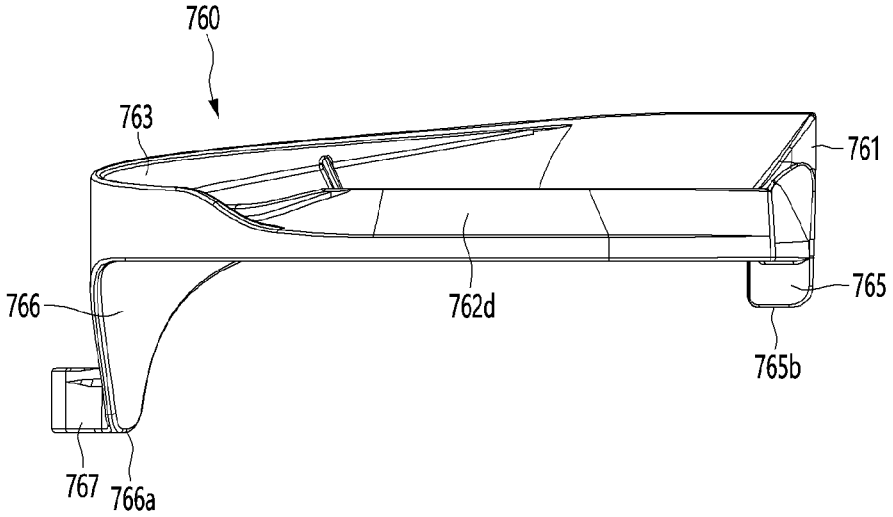
FIG. 9 is a side view of a frame according to an embodiment of the present disclosure.
Figure 10:
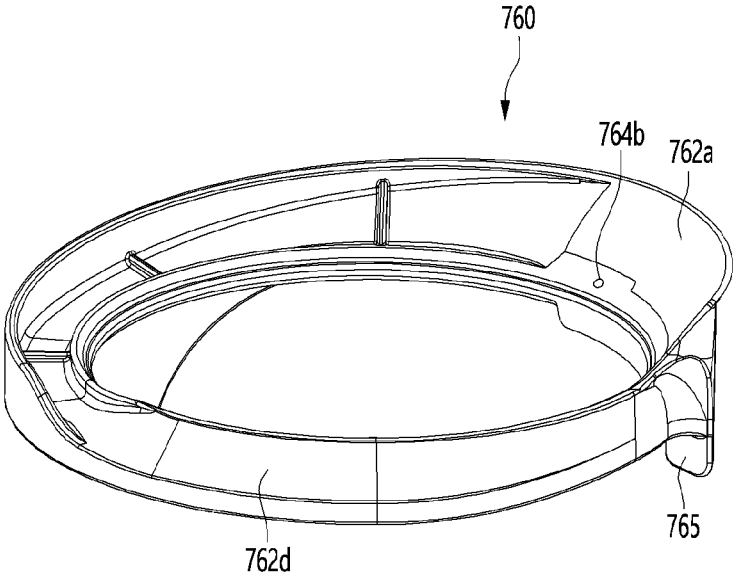
FIG. 10 is a perspective view of a frame of FIG. 8, viewed from a direction "A".

FIGS. 6 and 7 are perspective views of a compression mechanism according to an embodiment of the present disclosure. FIG. 8 is an exploded perspective view of a movable part according to an embodiment of the present disclosure. FIG. 9 is a side view of a frame according to an embodiment of the present disclosure. FIG. 10 is a perspective view of the frame of FIG. 8, viewed in an "A" direction.

Referring to FIGS. 6 to 10, the movable part 750 may include a frame 760. The frame 760 may compress dust stored in the first dust storage 120. Therefore, the frame 760 may have sufficient rigidity for preventing deformation during a pressing process, while effectively compressing dust during the process of compressing dust. For example, the frame 760 may be an injection-molded material or may be formed of a metal material (not limited to any particular material).

A maximum diameter of the frame 760 may be less than a diameter of an inner circumferential surface of the first cyclone part 110. Therefore, the frame 760 may be moved up and down in a state of being spaced apart from the inner circumferential surface of the first cyclone part 110.

In the case of the present embodiment, even if the movable part 750 moves in an eccentric state during a vertical movement process, frictional contact of the movable part 750 with the inner circumferential surface of the first body 1 (for example, the first cyclone part 110 and/or dust bin 112) may be prevented.

The frame 760 may support the cleaning part 770. The cleaning part 770 may be formed of an elastically deformable material. For example, the cleaning part 770 may be formed of a rubber material (not limited thereto).

The cleaning part 770 may be formed in a ring-like shape so that the cleaning part 770 may clean the entirety of the circumference of the cylindrical filter part 130. As another example, the cleaning part 770 may be formed of silicone or a fiber material.

When the cleaning part 770 is formed of an elastically deformable material, damage to the filter part 130 when the cleaning part 770 is in frictional contact with the filter part 130 may be reduced or prevented.

The movable part 750 may move from the compression standby position to a dust compression position. The cleaning part 770 may wait or be maintained at a position outside the filter part 130 at the compression standby position, and during a dust compression process, the cleaning part may wipe the outer surface of the filter part 130, while moving to the dust compression position.

The cleaning part 770 may include an annular cleaning body 771. The cleaning body 771 may include a cleaning end 771*a*. The cleaning end 771*a* may be in contact with the outer surface of the filter part 130 during the cleaning process.

In the present embodiment, since the cleaning part 770 is formed of an elastically deformable material, when the cleaning part is lowered and the cleaning end 771*a* comes into contact with the filter part 130, the cleaning part 770 may be elastically deformed outward in a radial direction of the filter part 130, and in the elastically deformed state, the cleaning end 771*a* may come into contact with the filter part 130.

Therefore, when the cleaning end 770 is lowered in a state where the cleaning end 771*a* is in contact with the circumference of the filter part 130, the cleaning end 771*a* removes dust adhered to the outer surface of the filter part 130.

In the case of the present embodiment, since the cleaning end 771*a* is moved in contact with the filter part 130, the cleaning part 770 may reduce eccentricity of the movable part 750 in the vertically moving process.

In one example, in a state where the movable part 750 is inclined with respect to a horizontal direction, a contact force between a portion of the cleaning end 771*a* and the filter part 130 increases, so that the cleaning end 771*a* is deformed and inclination of the movable part 750 may be reduced.

The cleaning body 771 may further include a coupling end 772 to be coupled to the frame 760. The coupling end 772 may be coupled to an inner surface of the frame 760.

For example, the cleaning part 770 may be coupled to the frame 760 by an insert injection molding process.

The cleaning body 771 may further include a depressed portion 773 recessed in a downward direction from the upper end. A lower extending portion 761*a* extending from the frame 760 may be located in the depressed portion 773. The lower extending portion 761*a* located in the depressed portion 773 may be aligned with the suction passage.

The frame 760 may include a frame body 761 supporting the cleaning part 770. At the compression standby position, a portion of the frame body 761 may be in contact with the outer surface of the air guide 170. A portion of the frame body 761 may surround an outer surface of the air guide 170 in a circumferential direction.

In one example, the frame body 761 may include a first body 762*a* surrounding the outer surface of the air guide 170. The first body 762*a* may also be referred to herein as a guide cover part.

For example, the first body 762*a* may be in contact with the air guide 170. The first body 762*a* may be disposed to face the suction opening 12*a* in a state of being spaced apart from the suction opening 12*a* at the compression standby position of the movable part 750.

The first body 762*a* may be inclined to have a first inclination angle with respect to a horizontal plane. Accordingly, among the dust introduced into the first cyclone part 110 through the suction opening 12*a*, dust in contact with the first body 762*a* may flow downward along the first body 762*a*.

That is, the frame body 761 may be designed and arranged to minimize acting as a flow resistance of air suctioned through the suction opening 12*a*, while a downward flow of dust is smooth, at the compression standby position of the movable part 750.

The frame body 761 may further include a second body 762*c* having a height that is lowered in a direction away from the first body 762*a*.

An inclination angle of the second body 762*c* with respect to the horizontal plane may be reduced in a direction that is away from the first body 762*a*. Therefore, the second body 762*c* may be spaced apart from the air guide 170.

The frame body 761 may further include a third body 762*d* extending from the second body 762*c*. An inclination angle of the third body 762*d* with respect to the horizontal plane may increase in a direction that is away from the second body 762*d*.

The third body 762*d* may be connected to the first body 762*a*.

The upper end 762*b* of the first body 762*a* is located above the upper end 762*e* of the third body 762*d*. Therefore, the upper end 762*b* of the first body 762*a* may be stepped from the upper end 762*e* of the third body 762*d*.

The frame body 761 may include a fourth body 762*f* inclined toward the center of the frame 760 from the upper end 762*e* of the third body 762*d*.

With respect to a vertical line passing through the upper end, the third body 762*d* is inclined downward to the outside and the fourth body 762*f* is inclined downward to the inside. An inclination direction of the fourth body 762*f* may be the same as an inclination direction of the first body 762*b*. At least a portion of the fourth body 762*f* may be in contact with the outer circumferential surface of the air guide 170.

In the present embodiment, a portion of the frame body 761 in contact with the air guide 170 may be referred to as a "contact body." For example, the first body 762*a* and the fourth body 762*f* may be referred to as "contact bodies."

An outer rib 763 extending upward may be provided on the outer circumferential surface of the second body 726*c*. A height of an upper end of at least a portion of the outer rib 763 may be lowered or decreased toward the third body 762*d*.

The lower extending portion 761*a* may extend in a downward direction from a lower side of the first body 762*a*.

The frame 760 may further include a lower extension wall 766 extending in a downward direction from the frame body 761. The lower extension wall 766 may be rounded in the circumferential direction of the frame 760.

The lower extension wall 766 may be located at a portion where the outer rib 763 is formed in the frame body 761.

The frame 760 may further include a coupling part 767 extending outward from the lower extension wall 766. The coupling part 767 may protrude in the horizontal direction from the lower extension wall 766. For example, the coupling part 767 may extend in the horizontal direction from the lower end 766*a* side of the lower extension wall 766. The second transfer part 730 may be connected to the coupling part 767.

In this embodiment, as the coupling part 767 is located on the lower end 766*a* side of the lower extension wall 766, the portion to which the operation force transferred from the transfer part first acts on the lower extension wall 766 which is a position spaced apart from the frame body 761, and thus eccentricity of the frame body 761 may be reduced.

In addition, in the present embodiment, as the coupling part 767 is located on the lower end 766*a* side of the lower extension wall 766, an increase in height of the cleaner 1 may be prevented, while a vertical movement stroke of the movable part 760 may be increased.

That is, as a distance between the coupling part 767 and the pressing part 714 of the operating part 710 is increased, the vertical movement stroke of the movable part 750 may be increased. When the vertical movement stroke of the movable part 750 is increased, compression performance of dust stored in the first dust storage 120 may be improved.

A buffer part 734 may be coupled to the second transfer part 730. The second transfer part 730 may be coupled to penetrate the buffer part 734. The buffer part 734 may be seated or accommodated on an upper surface of the coupling part 767 in a state where the buffer part 734 is coupled to the second transfer part 730.

The second transfer part 730 may penetrate an upper wall of the protruding body 180.

The buffer part 734 functions to absorb shock (e.g., force with respect to time) that occurs when the movable part 750 comes into contact with the upper side wall of the protruding body 180 in the process of moving from the dust compression position to the compression standby position, and accordingly, the occurrence of noise may be reduced.

The frame 760 may further include a frame guide 765 extending in a downward direction from the frame body 761. For example, the frame guide 765 may extend in a downward direction from an outer circumferential surface of the first body 762*a*.

The frame guide 765 may include a planar guide surface 765*a*. The guide surface 765*a* may guide a spiral flow of air in the process of air flowing through the suction part 5. The guide surface 765*a* may be substantially parallel to an extending line extending in a tangential direction of the first cyclone part 110.

The lower end 765*b* of the frame guide 765 may be located below the contact end 771*a* of the cleaning part 770. The lower end 765*b* of the frame guide 765 may be located above the lower end 766*a* of the lower extension wall 766.

The frame body 761 may include one or more first guide parts 764*a* and 764*b*. The first guide parts 764*a* and 764*b* serve to guide the movable part 750 to be located at a regular position in relation to the air guide 170 at the compression standby position.

In the present embodiment, the first guide parts 764*a* and 764*b* may be projections or recesses. FIGS. 8 and 10 illustrate the first guide parts 764*a* and 764*b* as recesses.

The first guide parts 764*a* and 764*b* may be recessed downward at one point of the frame body 761.

For example, a plurality of first guide parts 764*a* and 764*b* may be disposed to be spaced apart from each other in the circumferential direction of the frame body 761. The plurality of first guide parts 764*a* and 764*b* may be located at the same height in the frame body 761.

In consideration of the position of the coupling part 767 in the frame 760, some 764*a* of the plurality of first guide parts 764*a* and 764*b* may be located at the opposite side of the coupling part 767 in the frame body 761.

For example, some 764*a* of the plurality of first guide parts 764*a* and 764*b* may be provided on the fourth body 762*f*.

The other 764*b* of the plurality of first guide parts 764*a* and 764*b* may be located between some 764*a* of the plurality of first guide parts 764*a* and 764*b* and the coupling part 767 in the frame body 761 in the circumferential direction. For example, the other 764*b* of the plurality of first guide parts 764*a* and 764*b* may be provided on the first body 762*a*.

That is, the plurality of first guide parts 764*a* and 764*b* may be formed on a surface of the frame body 761 facing the air guide 170.

Figure 11:
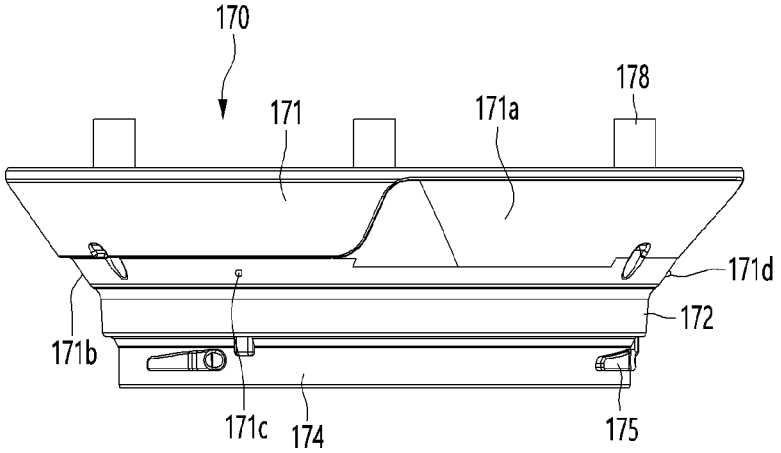
FIG. 11 is a side view of an air guide according to an embodiment of the present disclosure.
Figure 12:
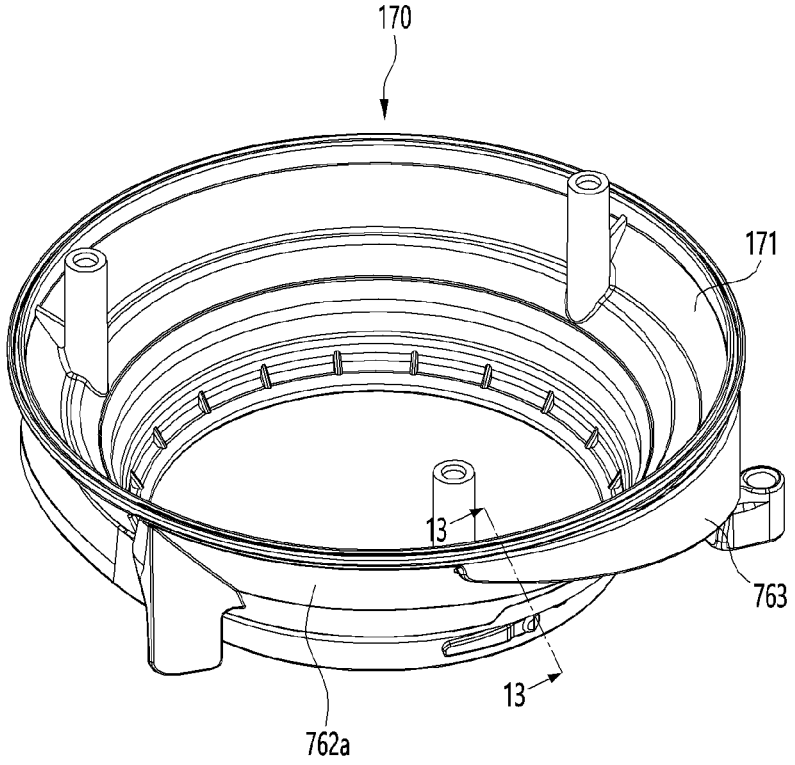
FIG. 12 is a view showing an arrangement relationship of a movable part and an air guide at a compression standby position of the movable part.
Figure 13:
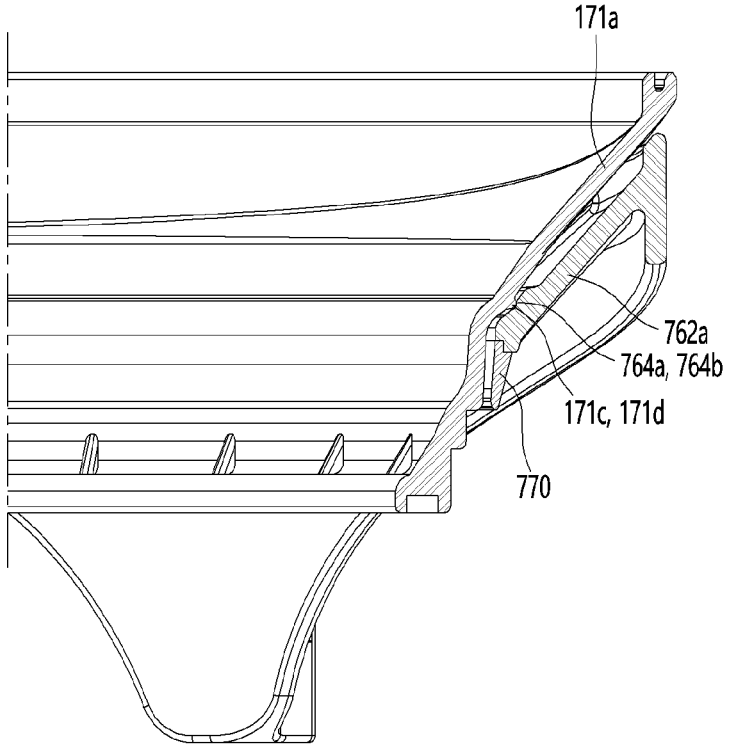
FIG. 13 is a cross-sectional view taken along line 13-13 of FIG. 12.

FIG. 11 is a side view of the air guide according to an embodiment of the present disclosure. FIG. 12 is a view showing an arrangement relationship of the movable part and the air guide at the compression standby position of the movable part. FIG. 13 is a cross-sectional view taken along line 13-13 of FIG. 12.

Referring to FIGS. 11 to 13, a position of the air guide 170 may be fixed in the housings 10 and 12.

The air guide 170 may be located in an inner region of the frame 760 at the compression standby position of the movable unit 750 and support the frame 760.

The air guide 170 may include a guide body 171. An inner circumferential surface of the guide body 171 may form a flow path guiding air discharged from the second cyclone part 140.

The guide body 171 may be provided in the form of a ring-like shape, for example, and at least a portion thereof may be reduced in diameter from the upper side to the lower side. That is, the guide body 171 may be inclined at a certain angle with respect to a vertical line or the axis A1 of the cyclone flow.

The guide body 171 may include a first seating portion 171*a* allowing a portion of the frame body 761 to be seated or accommodated thereon. The first seating portion 171*a* may be formed as an outer circumferential surface of the guide body 171 is recessed in a direction toward the center. The first body 762*a* of the frame body 761 may be seated or accommodated on the first seating portion 171*a*.

The guide body 171 may further include a second seating portion 171*b*. The second seating portion 171*b* may be formed as the outer circumferential surface of the guide body 171 is recessed in a direction toward the center. The first seating portion 171*a* and the second seating portion 171*b* are arranged in a circumferential direction of the guide body 171.

At least the fourth body 762*f* may be seated on the second seating portion 171*b* in the frame body 761.

The guide body 171 may further include an extending body 172 disposed to face the contact end 771*a* of the cleaning part 770 at the compression standby position. The extending body 172 may be located below the first seating portion 171*a* and the second seating portion 171*b*.

The guide body 171 may further include a coupling body 174 extending to a lower side of the extending body 172. The second cyclone part 140 may be coupled to the coupling body 174.

A coupling projection 175 may be formed on the outer circumferential surface of the coupling body 174. The coupling projection 175 may be accommodated in a projection recess (not shown) of the second cyclone part 140.

The air guide 170 may further include a fastening boss 178 (e.g., fastener) extending upward from the inner circumferential surface of the guide body 171. The air guide 170 may be fastened to one component in the body 2 by the fastening boss 178.

Meanwhile, the air guide 170 may further include second guide parts 171*c* and 171*d* which may be combined with the first guide parts 764*a* and 764*b*.

In this embodiment, the second guide parts 171*c* and 171*d* may be projections or recesses. That is, one of the first guide parts 764*a* and 764*b* and the second guide parts 171*c* and 171*d* may be a projection and the other may be a recess in which the projection is accommodated.

Hereinafter, an embodiment where the second guide parts 171*c* and 171*d* are projections will be described.

When the movable part 750 moves to the compression standby position, the second guide parts 171*c* and 171*d* may be inserted into the first guide parts 764*a* and 764*b*. That is, the second guide parts 171*c* and 171*d* may be coupled to the first guide parts 764*a* and 764*b* in a direction parallel to the axis of the cyclone flow.

A plurality of second guide parts 171*c* and 171*d* may be provided in the air guide 170 to correspond to the plurality of first guide parts 764*a* and 764*b*.

The plurality of second guide parts 171*c* and 171*d* may be arranged spaced apart from each other in the circumferential direction at the air guide 170.

In this embodiment, the second guide parts 171*c* and 171*d* may protrude from the guide body 171.

Because some 764 of the plurality of first guide parts 764*a* and 764*b* are provided in the fourth body 762*f* of the frame body 761, some 171*c* of the plurality of second guide parts 171*c* and 171*d* may be provided on the second seating portion 171*b*.

Because the other 764*b* of the plurality of first guide parts 764*a* and 764*b* is provided in the first body 762*a* of the frame body 761, the other 171*d* of the plurality of second guide parts 171*c* and 171*d* may be provided on the first seating portion 171*a*.

Referring to FIGS. 12 and 13, the frame body 761 surrounds the air guide 170 at the compression standby position of the movable part 750.

In addition, at the compression standby position of the movable part 750, the first guide parts 764*a* and 764*b* and the second guide parts 171*c* and 171*d* may be coupled.

By coupling the first guide parts 764*a* and 764*b* and the second guide parts 171*c* and 171*d*, the movable part 750 may be located at the regular position at the compression standby position and the state where the movable part 750 is located at the regular position may be maintained.

If the first guide parts 764*a* and 764*b* and the second guide parts 171*c* and 171*d* do not exist, the position of the movable part 750 relative to the fixed air guide 170 may be different.

If the movable part 750 is not located at the regular position with respect to the air guide 170, a portion of the frame body 761 in contact with the air guide 170 may not be in contact with the air guide 170 or a relative position of the frame guide 765 with respect to the suction opening 12*a* may be different.

In this case, air or dust suctioned through the suction opening 12*a* may flow between the first body 762*a* of the frame body 761 and the air guide 170 to increase a gap between the air guide 170 and the first body 762*a*, causing a possibility that the first body 762*a* acts as a flow resistance of air.

In addition, if the relative position of the frame guide 765 with respect to the suction opening 12*a* is different, the function of the frame guide 765 for causing air to be spirally flow is not smoothly performed but rather the frame guide 765 may act as a flow resistance of air.

However, according to the present disclosure, since the second guide parts 171*c* and 171*d* are inserted into the first guide parts 764*a* and 764*b* in the process in which the movable part 750 moves from the dust compression position to the compression standby position, the movable part 750 may be located at the regular position at the compression standby position.

In the case of this embodiment, the second guide parts 171*c* and 171*d* protrude from the guide body 171 which is an inclined portion and the first guide parts 764*a* and 764*b* are recessed at the inclined portion of the frame body 761.

Therefore, in the process of moving the moving part 750 from the dust compression position to the compression standby position, the second guide parts 171*c* and 171*d* may be more smoothly inserted into or seated on the first guide parts 764*a* and 764*b*.

As in the present embodiment, in a state where the first guide parts 764*a* and 764*b* and the second guide parts 171*c* and 171*d* are coupled, the movable part 750 based on the center of the movable part 750 may be prevented from being rotated horizontally.

Figure 14:
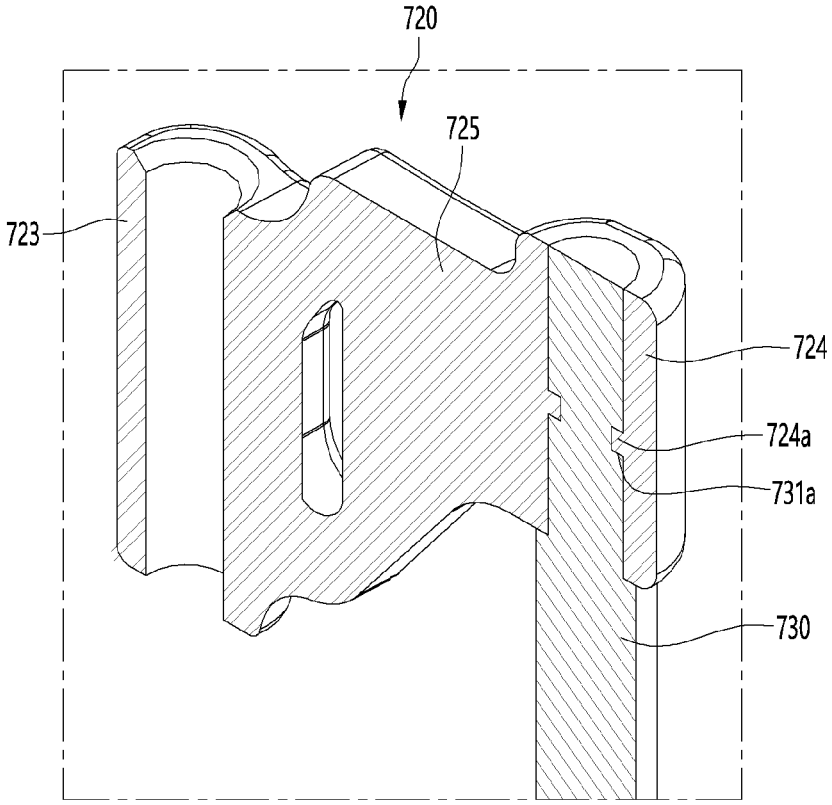
FIG. 14 is a cross-sectional view taken along line 14-14 of FIG. 7.

FIG. 14 is a cross-sectional view taken along line 14-14 of FIG. 7.

Referring to FIGS. 7 and 14, in the present embodiment, the first transfer part 720 and the second transfer part 730 may be formed of different materials.

For example, the second transfer part 730 may be formed of a metal material and the first transfer part 720 may be formed of a non-metal material.

The second transfer part 730 is a component which is directly connected to the frame 760 through the protruding body 180. When the second transfer part 730 is formed of a metal material, the second transfer part may be prevented from being deformed in the process of moving the transfer part 730.

When the first transfer part 720 is formed of a non-metal material, the first transfer part 720 may be more easily coupled with the second transfer part 730.

The second transfer part 730 may be formed in a cylindrical shape (not limited thereto). The first transfer part 720 may be connected to an upper portion of the second transfer part 730.

For example, the first transfer part 720 may be manufactured by an injection molding process and coupled with the second transfer part 730 (e.g., double injection molding).

Part of an upper portion of the second transfer part 730 may have a smaller diameter than other portions. The first transfer part 720 may be coupled to the portion having a small diameter of the second transfer part 730.

The first transfer part 720 may include a first connection portion 723 connected to the support bar 190, a second connection portion 724 connected to the second transfer part 730, and a connection body 725 connecting the first connection portion 723 and the second connection portion 724.

The second transfer part 730 may have a coupling recess 731*a* in the circumferential direction. The coupling recess 731*a* may be continuously formed around the second transfer part 730. That is, the coupling recess 731*a* may be formed in a ring-like shape.

The coupling recess 731*a* may be disposed at a position spaced downward from an upper end of the second transfer part 730.

When the first transfer part 720 is injection-molded, for example, the first transfer part 720 may include a coupling projection 724*a* inserted into the coupling recess 731*a*. For example, the second connection portion 724 includes the coupling projection 724*a*.

Since the coupling projection 724*a* is located in the coupling recess 731*a*, the first transfer part 720 may be limited from moving in a longitudinal direction of the second transfer part 730.

Meanwhile, since the coupling recess 731*a* is formed in a ring-like shape on the second transfer part 730, the coupling projection 724*a* may also have a ring-like shape. When the coupling projection 724*a* has a ring-like shape, the coupling projection 724*a* is horizontally rotatable in the coupling recess 731*a*. Therefore, the first transfer part 720 may be rotated relative to the second transfer part 730.

As described above, not only eccentricity of the movable part 750 must be prevented but also the movable part 750 must be located in the regular position at the compression standby position.

In case where there is an assembly error of the operating part 710 and the first transfer part 720 or an assembly error of other components as in this embodiment, if the first transfer part 720 and the second transfer part 730 do not relatively rotate, the second transfer part 730 is affected by the assembly error as is.

Then, since the movable part 750 connected to the second transfer part 730 is affected by the error, the first guide parts 764*a* and 764*b* and the second guide parts 171*c* and 171*d* may not be coupled in the process in which the movable part 750 moves to the compression standby position.

However, as in the present disclosure, if the relative position of the second transfer part 730 with respect to the first transfer part 720 is varied, the second transfer part 730 may exist without being affected by the error, and accordingly, the movable part 750 may not be affected by the assembly error.

Alternatively, the influence of the assembly error may be eliminated by the relative rotation of the first transfer part 720 and the second transfer part 730 in the process in which the movable unit 750 moves to the compression standby position.

For example, even if the positions of the first guide parts 764*a* and 764*b* and the second guide parts 171*c* and 171*d* are not perfectly aligned in an up-down direction in the process in which the movable part 750 moves to the compression standby position, the first guide parts 764*a* and 764*b* and the second guide parts 171*c* and 171*d* may be aligned and coupled to each other by the relative rotation of the second transfer part 730 and the first transfer part 720.

According to the proposed embodiment, after the compression mechanism moves for compression by the first guide part and the second guide part, it can accurately move to the compression standby position.

In addition, according to the present embodiment, since the transfer parts for transmitting the operation force of the operating part disposed a position eccentric from the center of the movable part to the movable part relatively rotate, the movable part may accurately move to the compression standby position even if the influence of the assembly error exists.

In addition, according to the present embodiment, in a state where the compression mechanism is accurately located at the compression standby position, the compression mechanism may not act as a flow resistance of air and guide air and dust flowing through the suction opening.

It will be apparent to those skilled in the art that various modifications and variations may be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A cleaner comprising:

a housing comprising a suction opening, a cyclone part configured to separate dust from air received through the suction opening, and a dust bin configured to store dust separated from air by the cyclone part;

a guide that is fixed inside the housing;

a frame configured to be movable to a first position that is a compression standby position and to a second position that is a dust compression position for compressing dust in the dust bin in the housing, the frame being in contact with the guide at the compression standby position;

a first guide part provided on the frame; and a second guide part provided on the guide and coupled to the first guide part at the compression standby position of the frame, wherein the frame faces the suction opening in a horizontal direction, and at least a portion of the frame is disposed to overlap with the suction opening in the horizontal direction at the compression standby position of the frame, wherein one of the first guide part and the second guide part is a projection and the other is a recess in which the projection is accommodated.

2. The cleaner of claim 1, wherein an inner circumferential surface of the guide guides a flow of air in the housing, wherein the frame is disposed to surround an outer circumferential surface of the guide, and wherein the second guide part is provided on the outer circumferential surface of the guide.

3. The cleaner of claim 2, wherein the frame comprises a contact body that is in contact with the outer circumferential surface of the guide, and wherein the first guide part is provided on the contact body.

4. The cleaner of claim 3, wherein the guide comprises a guide body inclined relative to an axis of a cyclone flow of the cyclone part, and wherein the second guide part protrudes from the guide body.

5. The cleaner of claim 4, wherein the guide body comprises a seating portion provided having a recessed portion and configured to allow the contact body to be seated thereon, and wherein the second guide part is provided on the seating portion.

6. The cleaner of claim 1, wherein the first guide part comprises a plurality of first guide parts spaced apart from each other in a circumferential direction of the frame, and wherein the second guide part comprises a plurality of second guide parts, whereby the number of the plurality of first guide parts is the same as the number of the plurality of second guide parts.

7. The cleaner of claim 6, further comprising:

an operating part provided outside of an exterior surface of the housing and configured to be operated by a user to move the frame; and a transfer part configured to transfer an operation force of the operating part to the frame, wherein the frame comprises:

a frame body comprising the plurality of first guide parts and disposed to surround the guide;

a lower extension wall extending in a downward direction from the frame body; and a coupling part provided on the lower extension wall and configured to allow the transfer part to be coupled thereto.

8. The cleaner of claim 7, wherein some of the plurality of first guide parts are located on the opposite side of the coupling part as the other of the plurality of first guide parts.

9. The cleaner of claim 8, wherein the other of the plurality of first guide parts are located in a region between the some of the plurality of first guide parts and the coupling part in a circumferential direction of the frame body.

10. The cleaner of claim 1, wherein the frame comprises:

a frame body comprising the first guide part and disposed to surround the guide; and a frame guide extending in a downward direction from the frame body and configured to guide air and dust received through the suction opening.

11. The cleaner of claim 1, further comprising:

an operating part provided outside of an exterior surface of the housing and operated by a user to move the frame; and a transfer part configured to transfer an operation force of the operating part to the frame, wherein the transfer part is connected to a position that is spaced apart from a center of the frame.

12. The cleaner of claim 11, wherein the transfer part comprises:

a first transfer part coupled to the operating part; and a second transfer part coupled to the first transfer part and the frame and extending in a direction parallel to an axis of a cyclone flow of the cyclone part.

13. The cleaner of claim 12, wherein the first transfer part is integrally coupled to the second transfer part to surround a portion of an outer side of the second transfer part.

14. The cleaner of claim 13, wherein the second transfer part comprises a metal material and the first transfer part comprises a non-metal material.

15. The cleaner of claim 13, wherein the second transfer part comprises a coupling recess continuously formed in a circumferential direction, wherein the first transfer part comprises a coupling projection accommodated in the coupling recess, and wherein the first transfer part and the second transfer part relatively rotate by the coupling recess and the coupling projection.

16. A cleaner comprising:

a housing including a cyclone part configured to separate dust from air and a dust bin configured to store the dust separated from the air by the cyclone part;

a frame configured to be movable to a first position that is a compression standby position and a second position that is a dust compression position for compressing dust in the dust bin in the housing;

a guide located at an inner region of the frame at the compression standby position of the frame and configured to support the frame;

a first guide part provided on the frame; and a second guide part provided on the guide and coupled to the first guide part at the compression standby position, wherein one of the first guide part and the second guide part is a projection and the other is a recess in w hich the projection is accommodated, wherein a cyclone flow of the cyclone part is vertically extended, wherein the first guide part and the second guide part are coupled in a direction that is parallel to an axis of the cyclone flow of the cyclone part, and wherein each of the guide and the frame comprises an inclined surface with respect to the axis of the cyclone flow of the cyclone part.

17. The cleaner of claim 16, wherein the frame is formed in a ring shape and surrounds the guide at the compression standby position of the frame.

18. The cleaner of claim 16, wherein the frame comprises a contact body that is in contact with the guide and wherein the first guide part is provided on the contact body.

19. The cleaner of claim 16, wherein the first guide part is provided on the inclined surface of the frame and the second guide part is provided on the inclined surface of the guide.

20. The cleaner of claim 16, wherein the first guide part comprises a plurality of first guide parts spaced apart from each other in a circumferential direction on the frame and are each arranged at the same height.

* * * * *